US005700966A

United States Patent [19]

LaMarra

[11] Patent Number: 5,700,966

[45] Date of Patent: *Dec. 23, 1997

[54] WIRELESS REMOTE CHANNEL-MIDI SWITCHING DEVICE

[76] Inventor: Frank LaMarra, 522 North Center, Royal Oak, Mich. 48067

[ * ] Notice: The term of this patent shall not extend beyond the expiration date of Pat. No. 5,576,507.

[21] Appl. No.: 502,287

[22] Filed: Jul. 13, 1995

Related U.S. Application Data

[63] Continuation-in-part of Ser. No. 364,553, Dec. 27, 1994, Pat. No. 5,576,507.

[51] Int. Cl.[6] ..... G10H 1/02

[52] U.S. Cl. ..... 84/645; 84/662

[58] Field of Search ..... 84/600–602, 615, 84/644, 645, 670, 718–721, 115, 376 A, 626–633, 662–665; 381/169, 172

[56] References Cited

U.S. PATENT DOCUMENTS

| | | | |
|---|---|---|---|
| 4,099,437 | 7/1978 | Stavrou et al. | 84/615 X |
| 4,126,070 | 11/1978 | Hill | 84/718 |
| 4,535,356 | 8/1985 | Nakagawa et al. | 84/115 X |
| 5,105,712 | 4/1992 | Barnard . | |
| 5,144,677 | 9/1992 | Asakura et al. | 381/169 X |
| 5,166,463 | 11/1992 | Weber | 84/600 |
| 5,212,733 | 5/1993 | DeVitt et al. . | |
| 5,245,128 | 9/1993 | Araiza . | |
| 5,296,641 | 3/1994 | Stelzel | 84/645 X |
| 5,300,730 | 4/1994 | Ekhaus . | |
| 5,323,257 | 6/1994 | Abe et al. | 381/172 X |
| 5,335,073 | 8/1994 | Yamamoto | 84/601 X |
| 5,388,493 | 2/1995 | Curetto | 84/376 A |
| 5,416,526 | 5/1995 | Yamamoto | 84/645 X |

OTHER PUBLICATIONS

Aquila Systems' MR2 Advertisement, Specification Sheet and Price List, Aquila Systems, Inc., Hatboro, PA 19040, Apr. 1, 1994 (3 pages).

"New A–T 300 Series Wireless Featured," *Audio Technica*, Summer 1994 (1 page).

RFM 1995 Product Data Book, RFM 4441 Sigma Road, Dallas, TX 75244 (pp. 1–13 through 5–24).

*Primary Examiner*—Stanely J. Witkowski

*Attorney, Agent, or Firm*—Harness, Dickey & Pierce, P.L.C.

[57] ABSTRACT

A miniature bank of switches is affixed directly to the musical instrument where it is easy to access during a live performance. The instrument-mounted unit produces an encoded signal representing the pattern and sequence of switch buttons depressed. This encoded signal is radiated, via UHF or infrared, to the remotely located musical instrument switching circuit. The switching circuit may be rack-mounted along with the effects devices which it controls. The switching unit receives the radiated signals and produces the corresponding MIDI protocol signals to control modern day MIDI effects devices, or alternatively produces signals which simulate ON/OFF wired foot switches to control effects of vintage amplifier equipment.

20 Claims, 11 Drawing Sheets

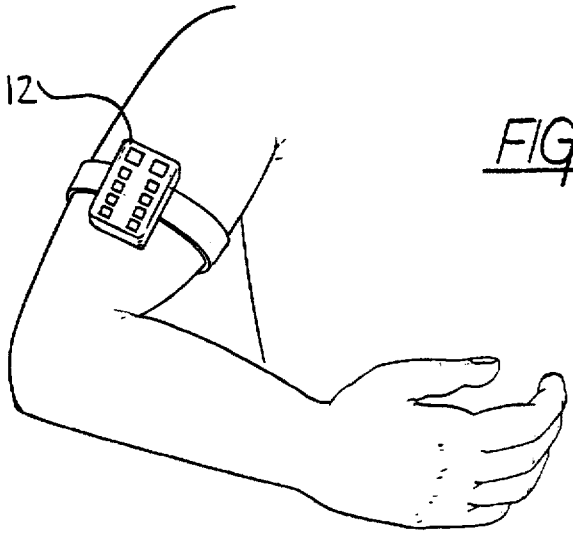
FIG - 20
FIG - 21
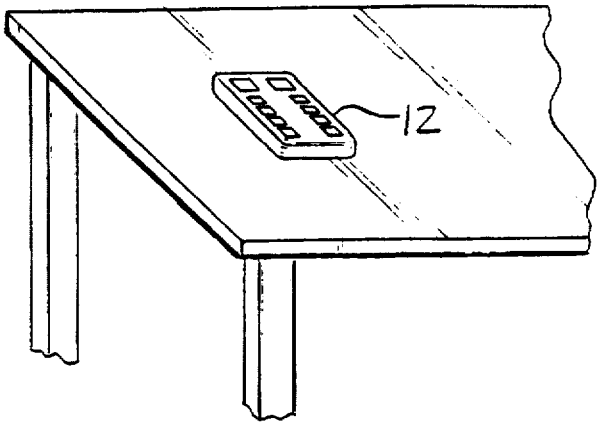
FIG - 22
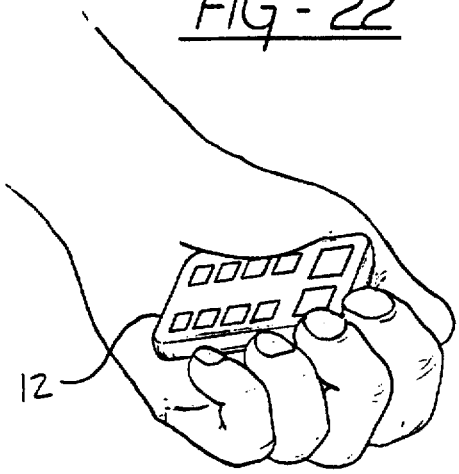
FIG - 23
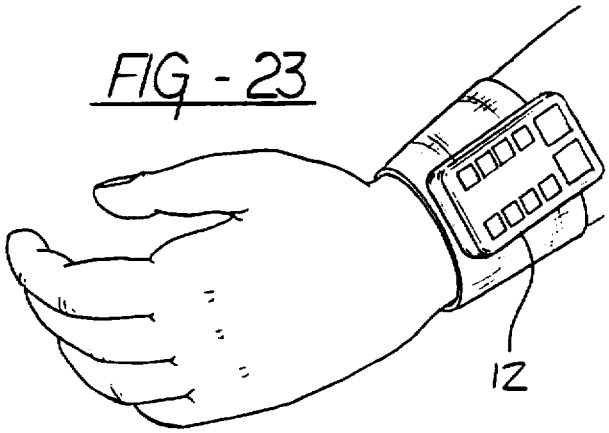
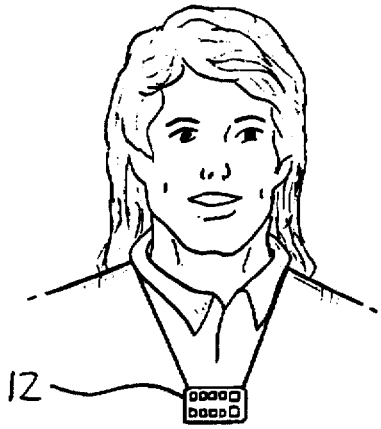
FIG - 24

WIRELESS REMOTE CHANNEL-MIDI SWITCHING DEVICE

CROSS-REFERENCE TO RELATED APPLICATIONS

This is a continuation-in-part of U.S. patent application Ser. No. 08/364,553, filed Dec. 27, 1994 of Frank LaMarra entitled "Wireless Remote Channel-MIDI Switching Device," issued as U.S. Pat. No. 5,576,507.

BACKGROUND AND SUMMARY OF INVENTION

The present invention relates generally to musical instruments and switched effects for musical instruments. More particularly, the invention relates to a wireless device, small enough to be attached directly to the face of a guitar, for switching different remotely located effects units, amplifier channels, MIDI devices, and the like.

For years after the electric guitar was invented, performing musicians found themselves tethered to their amplifiers, by the ubiquitous guitar chord which connected the output jack of the guitar to the input jack of the amplifier. Then, with the advent of FM transmitter technology, many musicians freed themselves of the guitar chord tether, using, instead, a wireless FM transmitter plugged into the guitar and an FM receiver plugged into the amplifier.

Although the wireless FM transmitter-receiver arrangement works well in many performance applications, it is considerably more expensive than the simple guitar chord. One reason for this expense is that the transmitter-receiver link is responsible for conveying the actual analog signal produced by the guitar pickups. To be a suitable replacement for the guitar chord, this FM link must be very clean and noise-free. Poor reception cannot be tolerated, since guitar amplifiers and sound reinforcement used in performance applications produce tremendous amplification, and any FM hiss or noise is also boosted by this amplification.

Guitar players and performing musicians are always searching for that "unique sound." Thus, today, there are scores of MIDI controlled effects units designed to alter the sound of the analog guitar signal. These devices include reverb units, echo units, chorus units, flangers, pitch shifters, harmonizers, wa-wa pedals, distortion units, vacuum preamps,—the list goes on. Even "purists" who shun these effects devices in favor of a vintage amplifier sound still, on occasion, like to switch from one amplifier channel to another, to achieve a different sound. Many vintage amplifiers, and modern non-MIDI amplifiers, have multiple input channels which can be preset for different effects. For example, channel 1 can be set to produce a clean, undistorted sound, and channel 2 can be overdriven to produce a biting, distorted lead guitar sound. Or, one of the channels can be dry (without effects) and the other channel can be wet (effected by tremolo or reverb).

The problem with using any of the above effects to achieve "that unique sound" is that the musician finds himself or herself again tethered to a stationary piece of equipment. This is because most effects units are either rack-mounted equipment, having front panel buttons and knobs for selecting the effects, or they are foot pedals intended to be placed on the floor next to the vocal microphone stand, for example. This means that even if the musician is using a wireless device to eliminate the guitar chord between the guitar and amplifier, the musician must still stand in one place if he or she wants to switch between effects, either by adjusting front panel controls on rack-mount units or by stepping on appropriate foot pedal switches. In a live performance this amounts to being tethered to the equipment. Heretofore, the only practical solution has been to employ a sound engineer to switch the effects for the musician on stage. However, this injects the problem of miscues and removes much of the spontaneity of the performance.

The present invention solves this problem. It provides a small switch bank device which can be mounted directly to the musical instrument, such as directly to the pick guard of the guitar, below the strings where it will not interfere with normal playing. A miniature transmitter packaged inside the switch bank emits a radiated signal in response to actuation of the switch bank switches.

The system also includes a musical device switching interface which is coupled to a receiver that receives the radiated signals from the transmitter. The receiver produces a control signal which corresponds to the actuation of the switch bank switches. The device switching interface produces MIDI protocol digital signals in accordance with the control signals produced by the receiver. The switching interface may also include one or more voltage switches or relay contacts which can be plugged directly into vintage amplifiers to effect channel switching in a way previously done only by a wired foot switch. If desired, the invention may be retrofit into existing effects equipment.

One of the advantages of the wireless remote controlled system of the invention is its tiny size. For all practical purposes, the size of the switch bank is limited only by the size of the human fingers. The switch bank buttons should be large enough for the musician to easily locate and activate them, even during a heated performance. Other than this, the switch bank can be quite small and can even be integrated into the guitar when it is manufactured. As will be more fully explained herein, one reason the switch bank is so small is that the circuitry located in the switch bank is not responsible for generating MIDI protocol digital signals. Instead, the musical device switching interface performs this function. That interface can be a larger rack-mounted unit, suitable for mounting adjacent the devices it is to control.

For a more complete understanding of the invention, its objects and advantages, reference made be had to the following specification and to the accompanying drawings.

BRIEF DESCRIPTION OF THE DRAWINGS

FIG. 20 illustrates the placement of the switch bank unit on an arm band for securing around the musician's arm;

FIGS. 21 and 22 illustrate how the switch bank unit may be configured for hand-held use, FIG. 21 depicting the unit placed on a tabletop and FIG. 22 depicting the unit in hand-held use;

FIG. 23 shows yet another embodiment of the switch bank unit that is adapted for attachment by wristband to the wrist of the musician; and FIG. 24 illustrates yet another embodiment in which the switch bank unit is worn by strap around the neck of the musician.

DESCRIPTION OF THE PREFERRED EMBODIMENT

Figure 1:
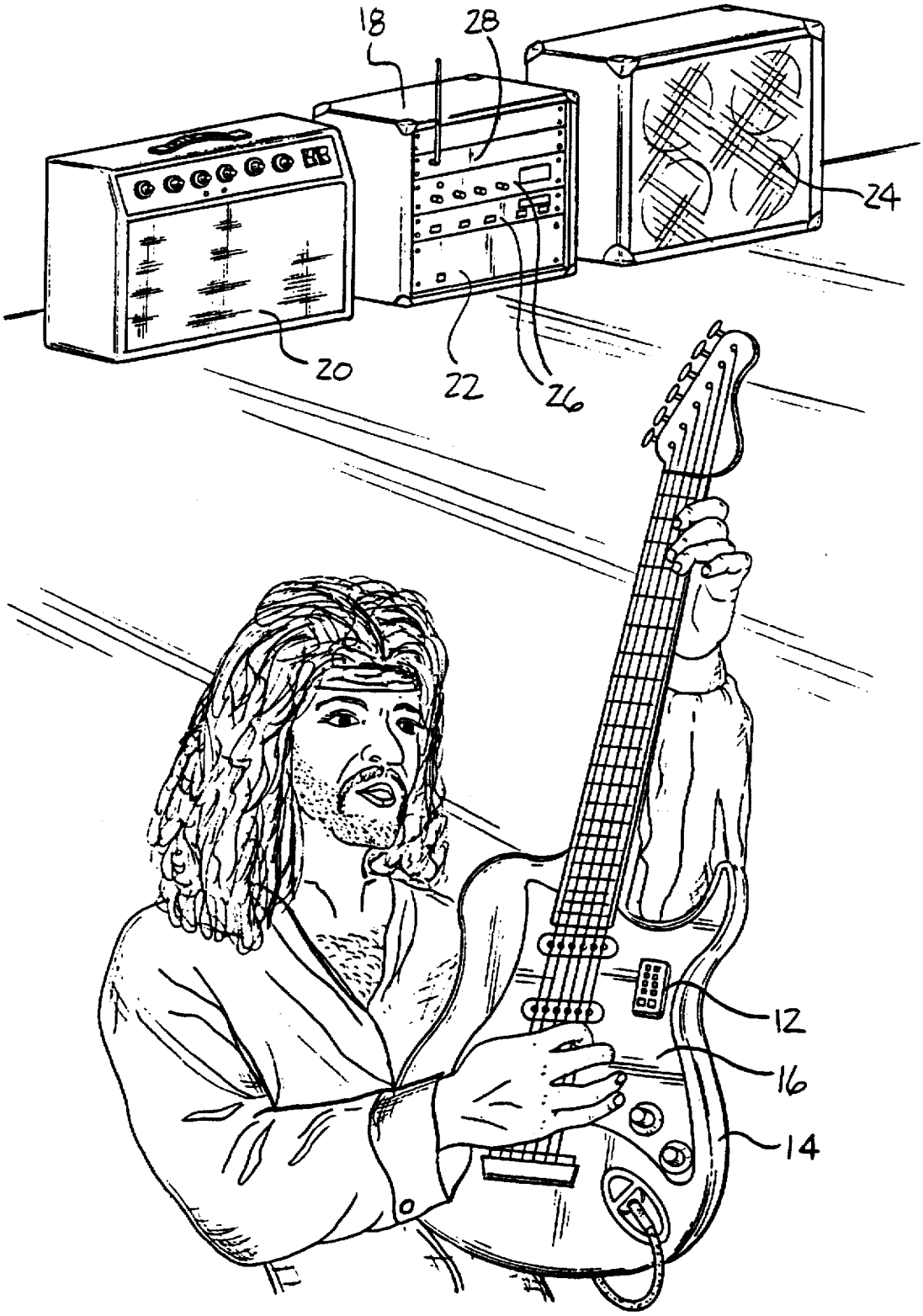
FIG. 1 is an overview of the wireless remote controlled musical instrument switching system of the invention, showing the switch bank located on the pick guard of the guitar and showing the musical device switching interface in a rack-mounted unit together with rack-mounted effects units and several amplifiers.

Referring to FIG. 1, the switch bank 12 is mounted directly on the musical instrument, in this case a guitar 14, as by attaching to the pick guard 16. In the background of FIG. 1 there is illustrated a rack-mount cabinet 18, a vintage two-channel amplifier 20, a rack-mount amplifier 22 with a speaker enclosure 24 and a plurality of MIDI controlled effects units 26. The musical device switching interface of the invention is illustrated at 28.

Figure 2:
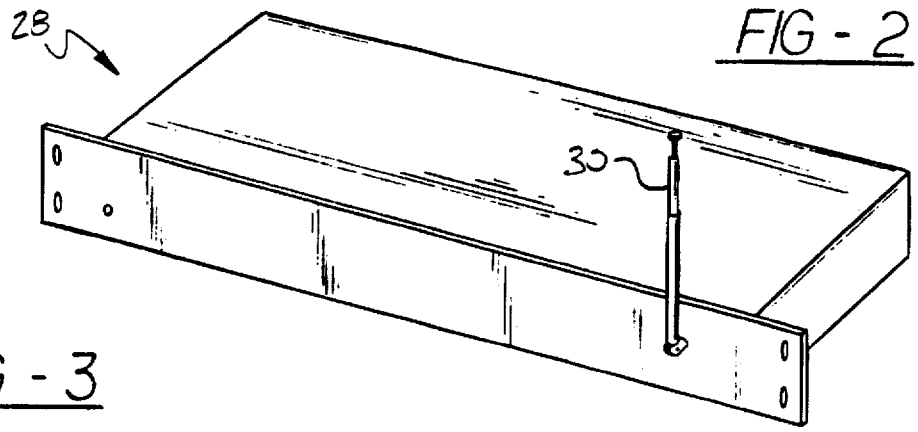
FIG. 2 is a front perspective view of the rack-mountable musical device switching interface.
Figure 3:
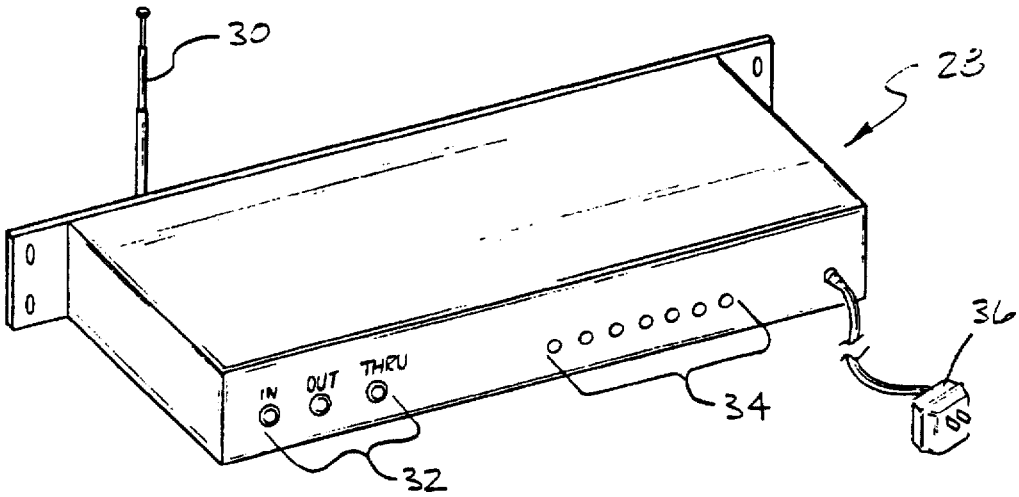
FIG. 3 is a rear perspective view of the interface of FIG. 2.

The musical device switching interface 28 is shown in greater detail in FIGS. 2 and 3. The presently preferred embodiment houses the musical device switching interface in a rack-mountable cabinet, as illustrated in FIGS. 2 and 3. Of course, the switching interface could be packaged differently, if desired. On the front face of the switching interface is an antenna 30. The antenna is internally coupled to the receiver circuitry which is described more fully below. If desired, multiple antennas may be used, with separate RF circuitry if desired, to reduce the possibility of signal drop-out. As seen in FIG. 3, the switching interface includes MIDI IN, OUT AND THRU jacks 32, as well as a plurality of optional voltage switched jacks 34. The switching interface 28 may be powered by an external wall mounted power supply 36.

The MIDI IN, OUT AND THRU jacks 32 comply with MIDI protocol standards. The IN jack receives MIDI signals from other MIDI devices; the OUT jack supplies MIDI signals generated by the musical device switching interface 28; and the THRU jack routes MIDI signals fed in through the IN jack, to allow the switching interface 28 to be connected in a daisy-chain fashion with other MIDI devices.

The voltage switching jacks 34 supply an open circuit/closed circuit signal, in effect, simulating the opening and closing of a single pole, single throw switch. Many vintage and non-MIDI guitar amplifiers are constructed to switch effects such as reverb and tremolo in and out using a single pole, single throw switch mounted in foot pedal and connected by wire to the amplifier. Voltage switched jacks 34 simulate this type of foot pedal, to allow the musical device switching interface 28 to control equipment which is normally controlled by single pole, single throw foot switches. A plurality of jacks 34 are provided. Each simulates a separate switch. Thus jacks 34 can control a plurality switched devices at the same time.

Figure 4:
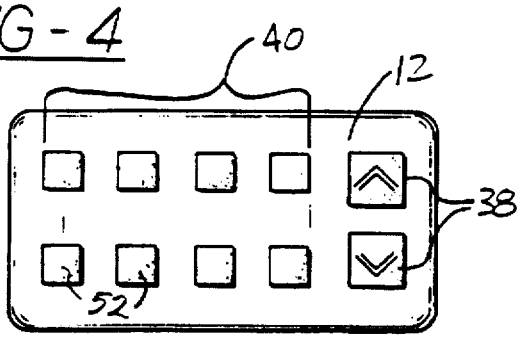
FIG. 4 is a plan view of a switch bank unit in accordance of the invention.

Referring to FIG. 4, the switch bank 12 is shown in greater detail. The illustrated embodiment is simply one possible configuration. Generally speaking, there can be a wide variety of different button configurations. The presently preferred embodiment has a pair of bank switch buttons 38 for incrementing and decrementing the MIDI bank number. The switch bank also includes a plurality of individual MIDI patch selection buttons 40 for selecting individual patches within a given bank. For example, a given MIDI bank may include 128 patches. Thus if eight banks are provided, this yields 1,024 possible MIDI switching combinations. The musician would probably elect to assign a given song or set of songs to a single bank and then use the individual patch selection buttons to switch the appropriate effects on and off, as required.

Figure 5:
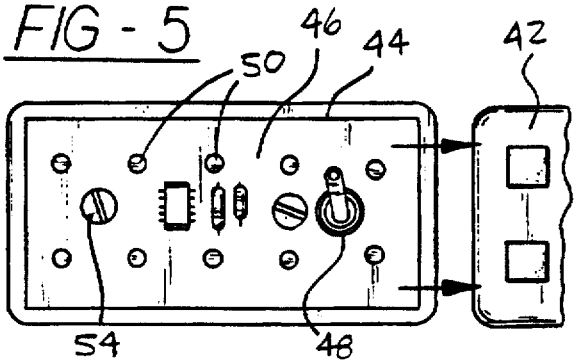
FIG. 5 illustrates one embodiment of the switch bank unit, opened to reveal the internal components thereof.

The switch bank can be fabricated in a variety of different ways. A presently preferred embodiment is illustrated in FIG. 5. As shown in FIG. 5 the switch bank is fabricated as an interfitting clamshell arrangement with the top 42 being removable from the bottom 44 to reveal the circuit board 46 and battery 48. The individual push button switches may be membrane switches 50 disposed on circuit board 46 and actuated by push pads 52 which are mounted on the top 42. Membrane switches are inexpensive, waterproof and reliable, and the push pads can be fabricated with sufficient "play" to give tactile feedback to the user.

Figure 6A:
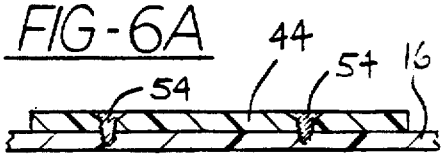
FIGS. 6*a*, 6*b* and 6*c* show various means of attaching the switch bank unit to the face of the guitar.
Figure 6B:
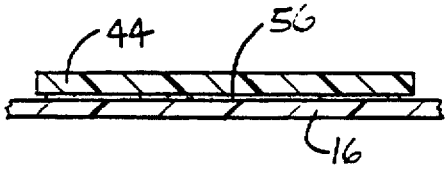
Figure 6C:
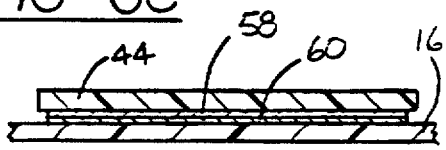

The switch bank can be attached to the instrument in a variety of different ways. Three ways are illustrated in FIGS. 6*a*, 6*b* and 6*c*. In FIG. 6*a* screws 54 are used to attach the bottom member of the switch directly into the pick guard of the guitar. The screw heads are accessible through holes in the circuit board 46 (see FIG. 5). Alternatively, the bottom portion can be attached to the pick guard 16 by foam-backed, double-sided tape 56. Alternatively, the bottom portion 44 can be attached to pick guard 16 using Velcro 58.

The switch bank can be attached anywhere on the instrument. For most players the best location is below the strings where it is easily reached by the picking hand and where it is out of the way during picking hand strumming. Also, while the invention has been illustrated using a guitar, the invention is not limited to a guitar and it can be used with virtually any musical instrument, including other stringed instruments, brass and woodwind instruments, and even microphones for vocalists.

Figure 7:
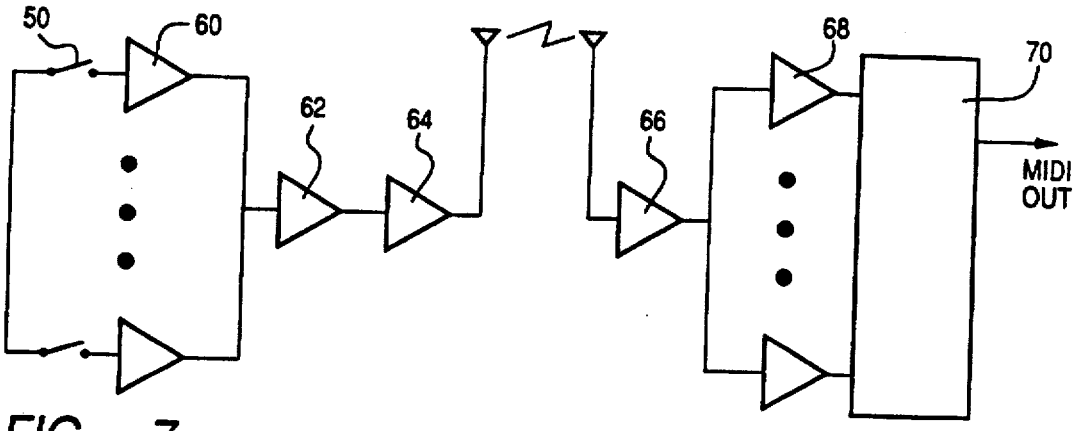
FIG. 7 is a system block diagram of the invention showing the system for producing MIDI protocol digital signals.
Figure 8:
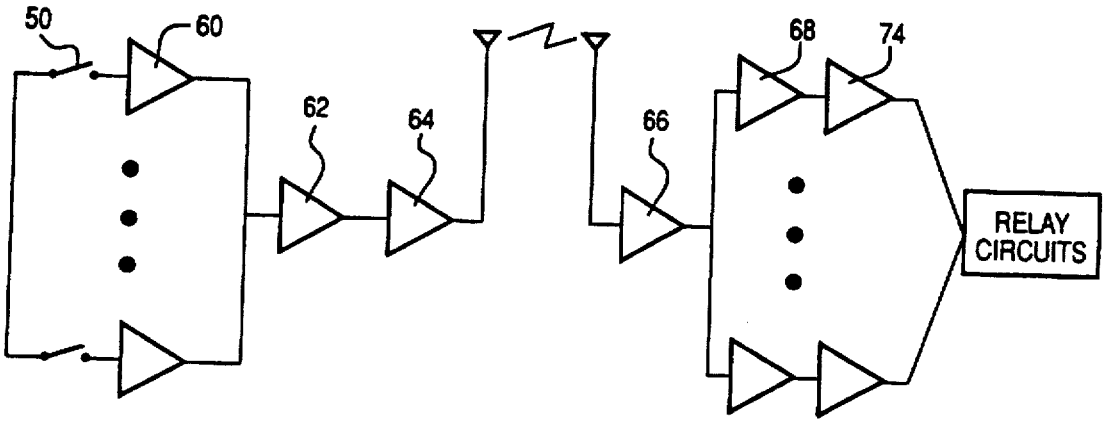
FIG. 8 is similar block diagram illustrating the system for providing voltage switching controls for vintage and non-MIDI amplifying equipment.

Referring to FIGS. 7 and 8, a presently preferred embodiment of the system is shown in block diagram. Specifically, FIG. 7 shows how to implement the invention for providing MIDI control signals and FIG. 8 shows how to implement the invention to provide ON/OFF control of vintage guitar amplifier equipment. Much of the circuitry is common to both, hence, where applicable, like reference numerals are assigned to like components.

In FIGS. 7 and 8 the push button activated switches are shown as individual single pole single throw, momentary contact switches 50. Each of these switches is connected to a buffer circuit 60, which debounces the momentary signal produced by the switch contacts and provides a consistent, uniform length output pulse. The outputs of buffers 60 are connected to encoder or multiplexer circuit 62. The multiplexer circuit combines the individual switching signals from switches 50 into a single pulse train. If desired, the multiplexer circuit can be configured so that each of the individual switches 50 is assigned to a different time slot within the composite multiplexed signal. Of course, other encoding schemes can be used as well.

The output of multiplexer 62 is then fed to UHF transmitter 64, which broadcasts a radio frequency signal. Although the UHF transceiver is presently preferred, the invention can be implemented at other frequencies, including infrared frequencies. Thus, while the UHF radio frequency signal is presently preferred, any radiated signal is suitable.

Within the musical device switching interface 28 is a UHF receiver 66 which supplies an output to a plurality of decoding or demultiplexing circuits 68. The demultiplexing circuits correspond in number to the number of switches 50 on the switch bank unit. In the case of the MIDI system illustrated in FIG. 7, the outputs of the demultiplexing circuits 68 are supplied to a MIDI protocol generator 70. In the case of the vintage guitar amplifier switching circuit (FIG. 8) the outputs of demultiplexing circuit 68 are coupled to resettable latches 74, which may in turn be connected to relay circuits within the musical amplifier equipment.

Figure 9:
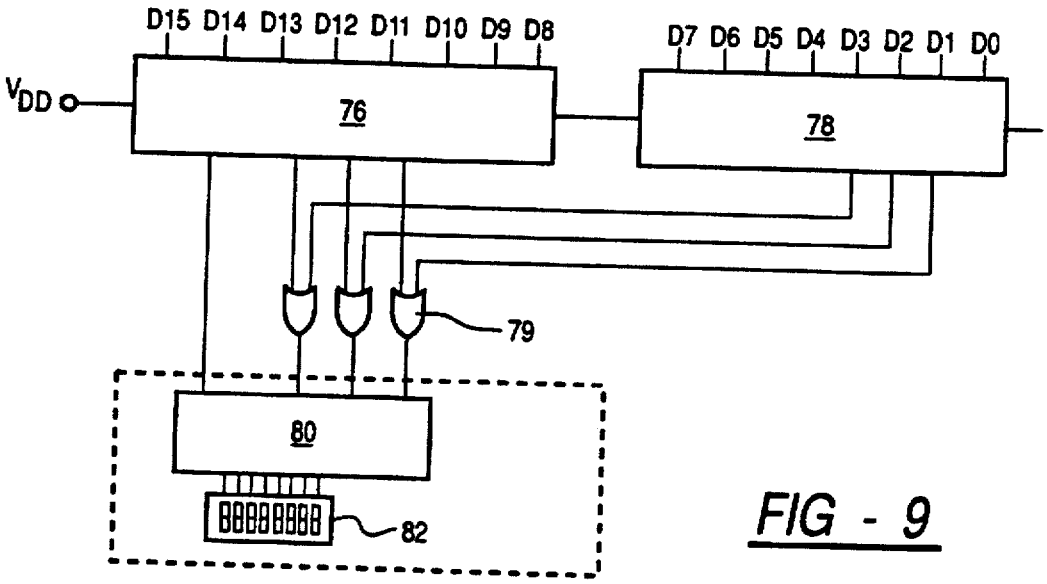
FIG. 9 is a schematic diagram of the transmitter.

One presently preferred transmitter is shown in FIG. 9. As illustrated, the circuit employs two MC145328 integrated circuits 76 and 78 which are cascaded together to provide a four bit output. Note the use of NOR gates 78 which supply the least three significant digit outputs. The four bit output signal is supplied to an HT680 integrated circuit transmitter 80. The transmitter circuit 80 includes a plurality of pins which are connected to DIP switch 82 to allow the device to be programmed with a predefined security code. This allows multiple units to be used in proximity without having one unit interfere with the other.

Figure 10:
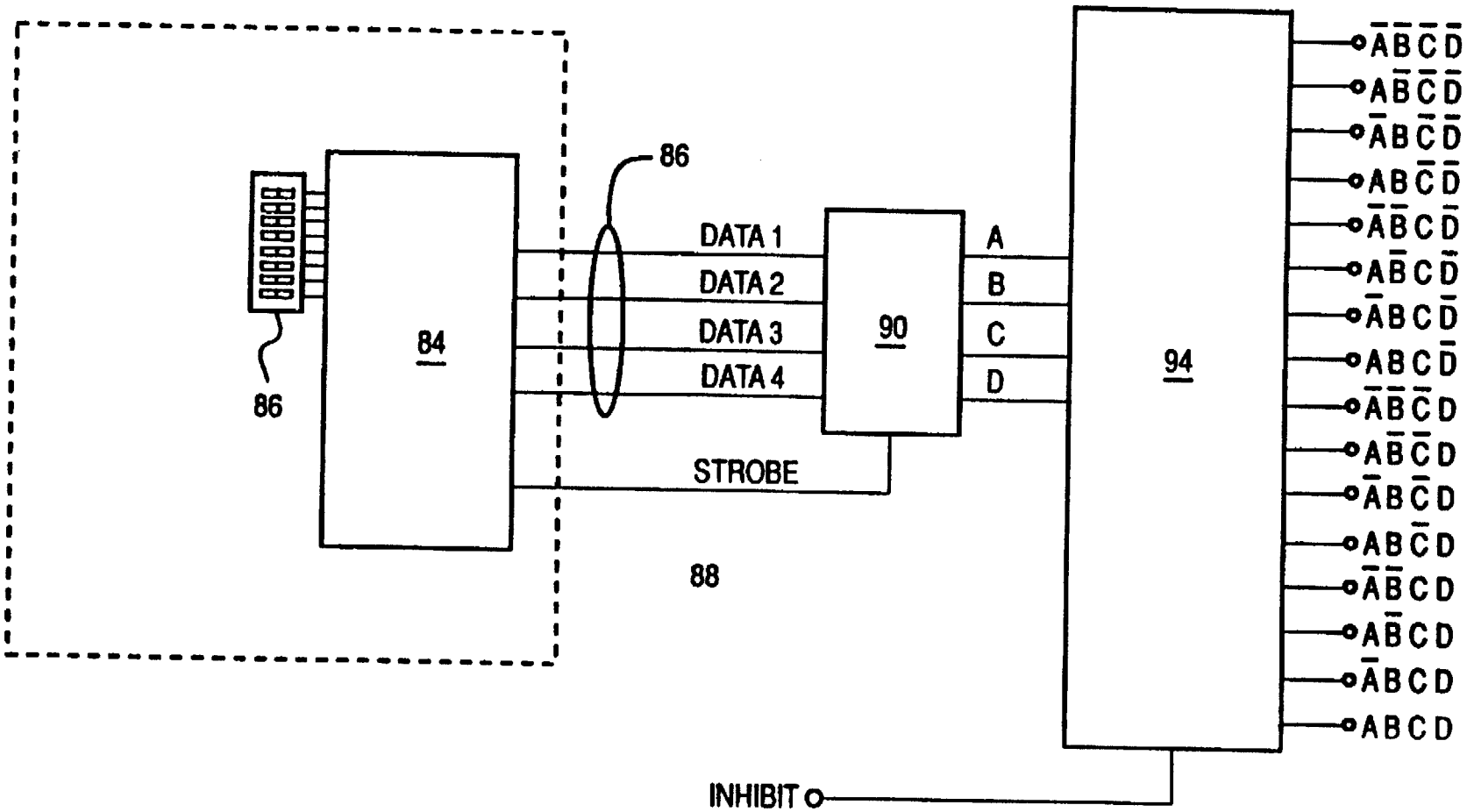
FIG. 10 is a schematic diagram of the receiver.

The receiver of one presently preferred embodiment is shown in FIG. 10. The receiver includes a complimentary HT684 receiver circuit 84 which is also provided with a DIP switch 86, used to select the same security pattern for the receiver. The output of receiver circuit 84 is a four bit parallel signal on bus 86 and a strobe signal on lead 88. These are connected to a latch circuit 90. The latch circuit is strobed by the signal on the strobe lead 88 and holds the four bit data word on its output bus 92. The four bit data word on bus 92 is read by a 4 to 16 decoder 94, which supplies, on separate output leads, logic signals indicating each of the possible 16 states which the four bit word can occupy.

A presently preferred embodiment uses a low power wireless transmitter and receiver pair available from RFM corporation, 4441 Sigma Road, Dallas, Tex., 75244. The preferred transmitter is the HX series of hybrid transmitter, such as the HX1002-1. The corresponding receiver is the RX series receiver, such as the RX1100. These devices operate on a nominal frequency of 303.825 megahertz and use SAW filter technology. The carrier frequency is quartz surface acoustic wave (SAW) stablized and output harmonics are suppressed by a SAW filter. The receiver uses dual surface acoustic wave (SAW) devices to achieve excellent selectivity and sensitivity. These circuits are presently preferred for critical applications, such as live performances on large outdoor stages where receiver sensitivity and signal path distortion issues are of greater concern.

In operation, the musician connects the MIDI OUT jack of the musical device switching interface 28 with the MIDI IN jack of a MIDI controlled effects devices. If multiple devices are used, they may be daisy-chained by connecting the MIDI THRU jack of the first device with the MIDI IN jack of the second device, and so forth. Then, the musician programs the effects device or devices, assigning different effects to different MIDI bank and patch numbers. If vintage guitar amplifiers are also being used, a standard guitar chord can be used to connect any foot switch control jack on the amplifier equipment with one of the voltage switched jacks 34 on the musical device switching interface 28.

Then, assuming the battery has been installed in the switch bank unit 12, the musician can begin to play. By selecting the appropriate bank switch buttons 38 and patch selection buttons 40, any desired bank and patch can be remotely selected. Each time a button on the switch bank is pushed, an encoded signal is generated by the multiplexer 62, with the identity of the button pushed being represented by a particular digital code. Specifically, the multiplexer 62 converts the parallel data signal from switches 50 into a serial signal suitable for broadcasting in a form of an emitted radiated signal.

The encoded signal is then received and demodulated by receiver 66 and the demultiplexing circuits 68 convert the signal back into a parallel signal, with each demultiplexing circuit output corresponding to one and only one of the switches 50. These parallel data are read by MIDI protocol generator 70, which produces a standard MIDI protocol signal, specifically a MIDI program change signal, to which the MIDI effects units respond. By supplying the effects units with a standard MIDI protocol signal, the effects units respond in precisely the same way as if the program change instructions had been entered via push buttons on the front panel of the effects units.

One benefit of the multiplexed signal produced by multiplexer 62 is that the necessary ON/OFF information and the necessary switch identity information are encoded without the need to resort to a fully MIDI protocol compliant signal. This allows the switch bank unit to be manufactured in a small economical package. MIDI protocol circuitry, by comparison, is too complex, bulky and expensive to readily implement in a package which can be mounted on the face of a guitar.

The non-MIDI (e.g., vintage) switching circuitry works in a similar fashion, except that the demultiplexed outputs of circuits 68 drive resettable latching circuits which, in effect, simulate the ON/OFF toggle switches found in conventional wired foot pedal switches. Alternatively or additionally momentary switches may be used. If desired, the circuitry of FIGS. 7 and 8 can be combined into a single package, allowing the musician to control both MIDI equipment and also vintage amplifier equipment or effects and even lighting equipment. In this regard, much of the circuitry for these two applications is common to both. Hence, both functions can be readily implemented in a common package, although some may prefer separate packages for the MIDI and non-MIDI switching components.

Figure 11:
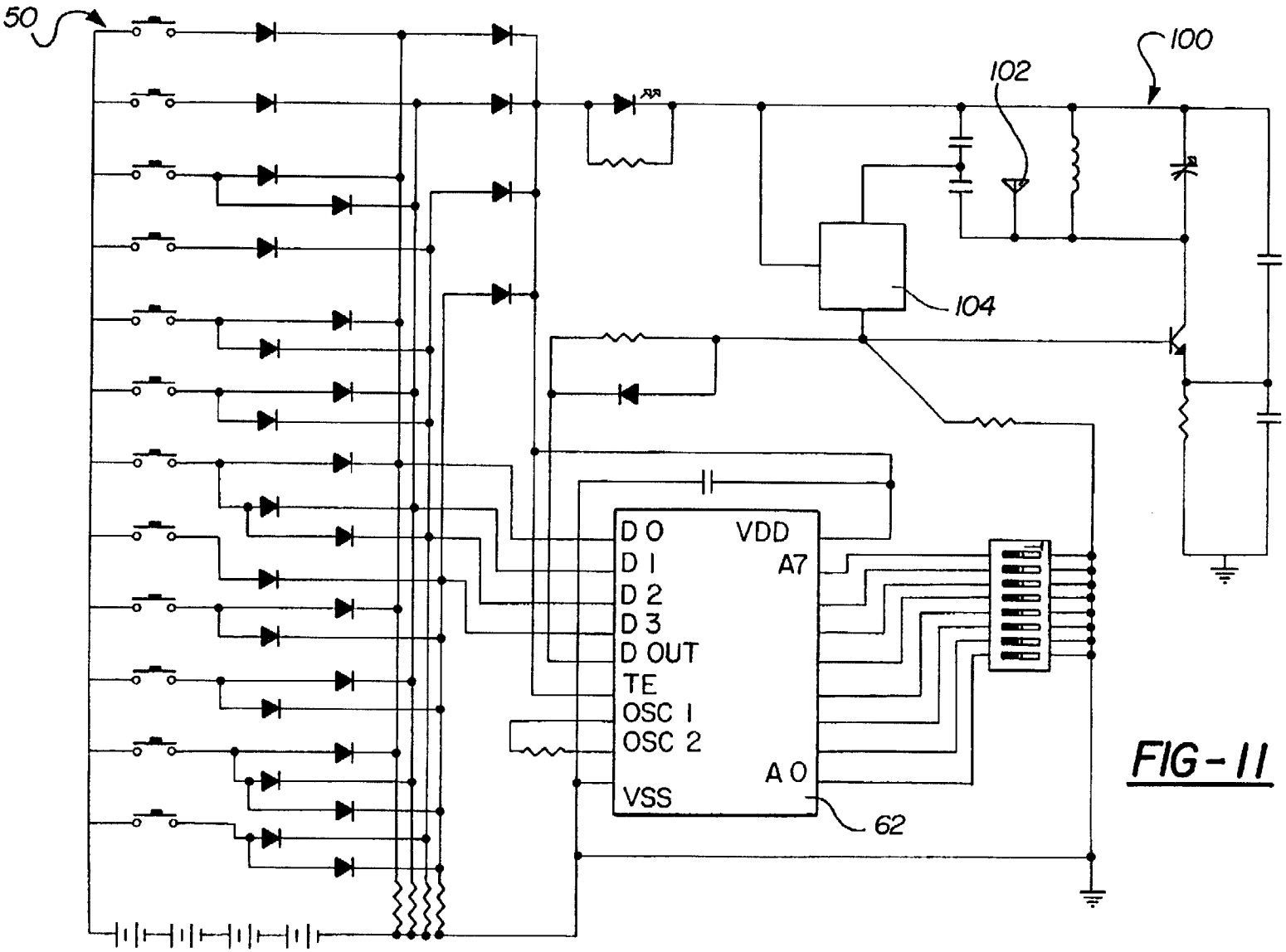
FIG. 11 is a schematic diagram illustrating the presently preferred UHF transmitter.
Figure 12:
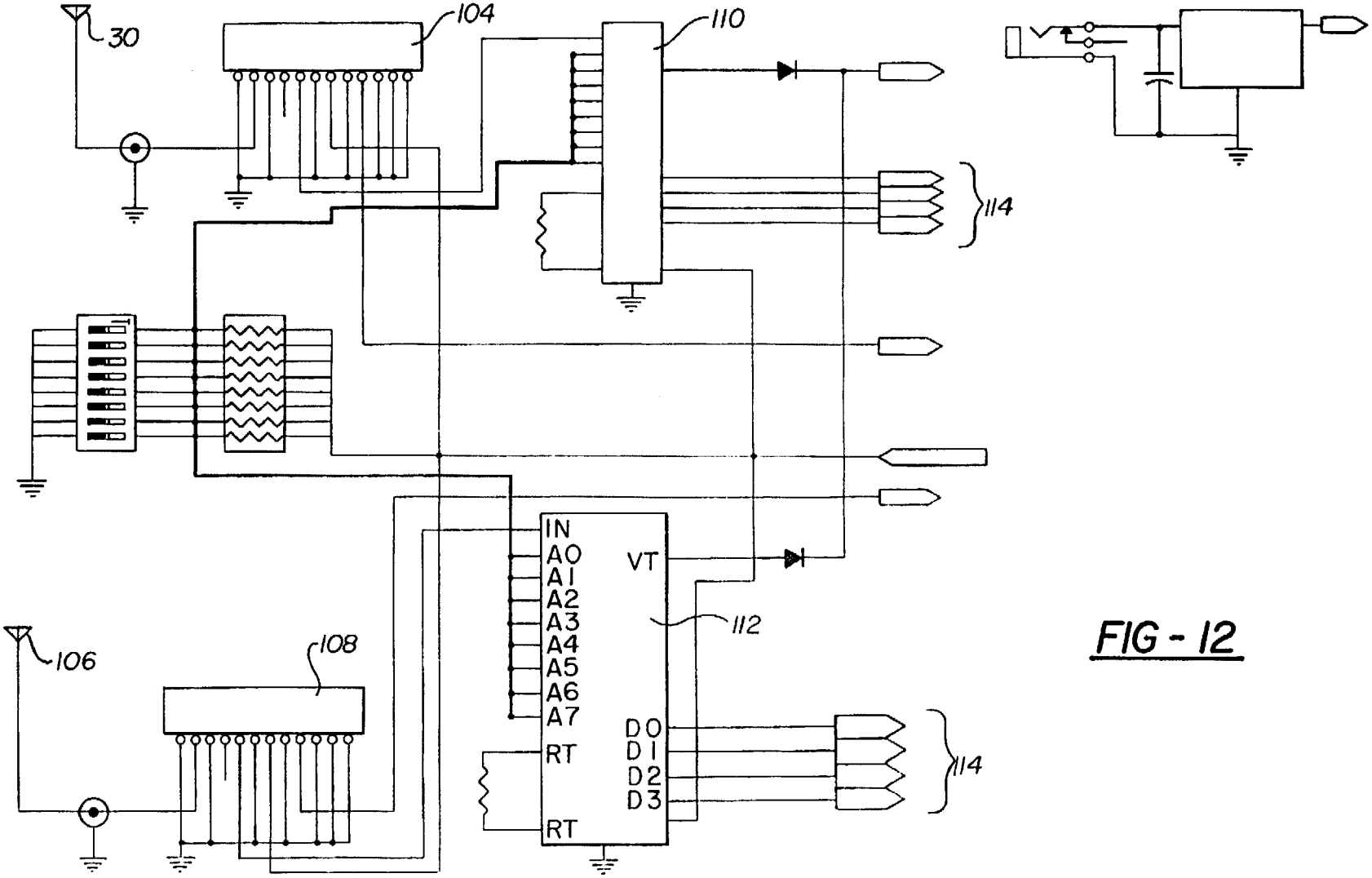
FIG. 12 is a schematic diagram illustrating the RF front end and decoder circuitry of the presently preferred RF receiver.
Figure 13:
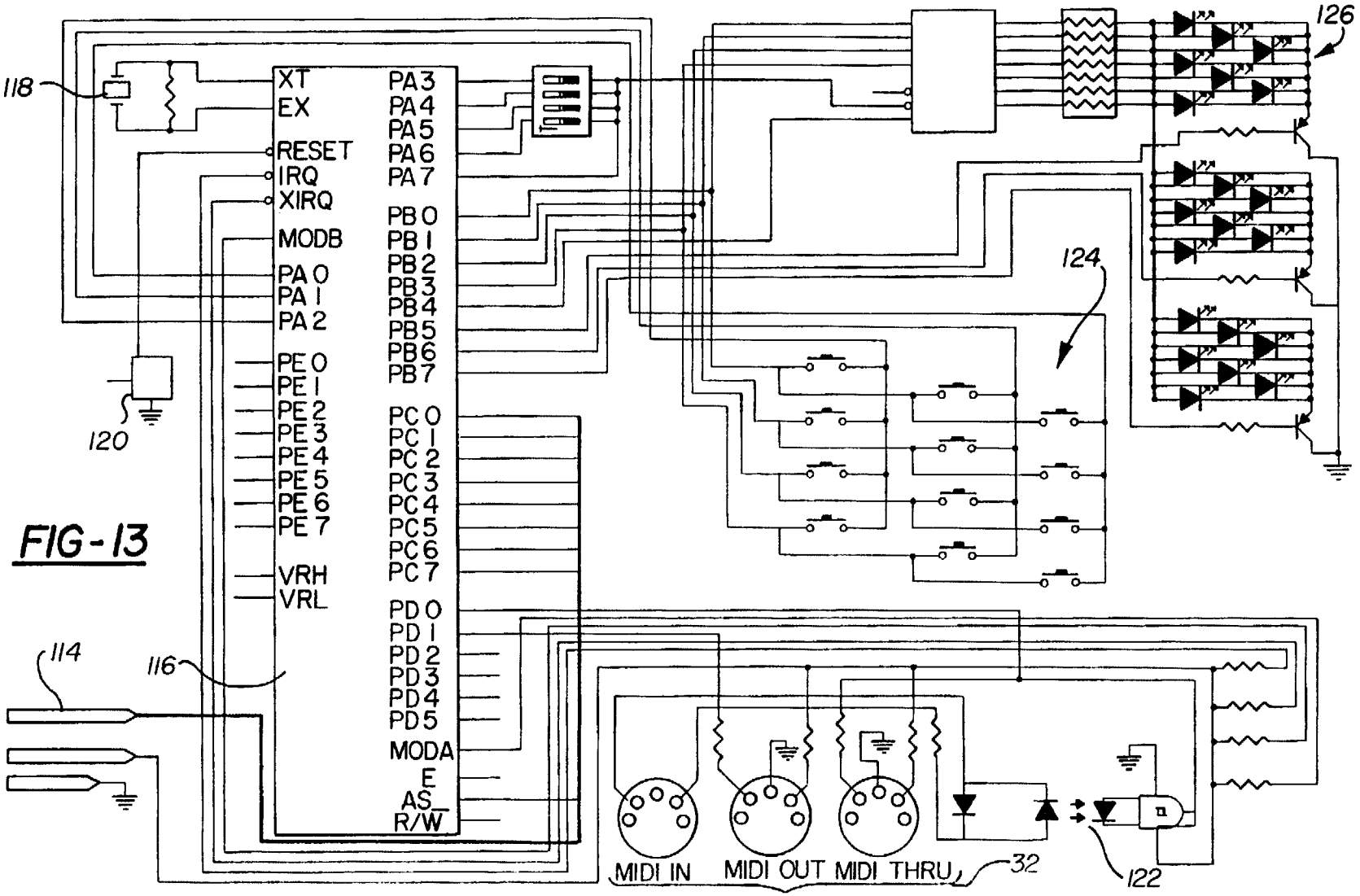
FIG. 13 is a schematic diagram illustrating the presently preferred microprocessor-based switching circuit.

A second presently preferred embodiment of the electronic circuitry is illustrated in FIGS. 11, 12 and 13. In FIG. 11 a 12 channel UHF transmitter is illustrated. The momentary contact switches 50 are coupled through diodes to the encoder circuit 62. The encoder circuit is coupled to the RF oscillator circuit 100, to which the transmitter antenna 102 is coupled. The oscillator circuit uses a 304 megahertz saw filter 104 to establish the proper RF carrier frequency.

The RF receiver is depicted in FIG. 12. The RF signal enters on antenna 30, which may be coupled through a BNC connector to the RF receiver module 104. To minimize the possibility of signal dropout, a second antenna 106 and second RF receiver module 108 may be employed. The outputs of receiver modules 104 and 108 are supplied to decoding circuits 110 and 112, respectively, where the serial signal from the receiver module is converted to parallel signals assigned to individual receiver ports collectively designated 114. These ports 114 are in turn supplied as inputs to a microprocessor-based switching circuit illustrated in FIG. 13. In FIG. 13 a single (parallel) port 114 has been illustrated. It should be understood that port 114 in FIG. 13 represents a plurality of individual receiver ports, each comprising one signal path of a multi-lead bus.

The presently preferred embodiment of FIG. 13 uses a 68HC11 microprocessor-based computer on a chip. As illustrated, suitable external components are conventionally connected to the microprocessor/computer 116. For example, the clock speed of microprocessor/-computer 116 is controlled by crystal circuit 118. Regulated power is supplied by circuit 120. MIDI ports 32, specifically MIDI IN, MIDI OUT and MIDI THRU are connected to additional ports of the microprocessor/computer 116, as illustrated. The connection is made via opto-isolator circuit 122.

If desired, the switching circuit of FIG. 13 can be provided with its own bank of switches 124 and also with a display comprising a light emitting diode array 126. This array can be used to provide a visual indication of the selected bank and effect.

The microprocessor/computer 116 is programmed to supply the appropriate MIDI standard protocol signal to select a given bank and voice or effect in response to input signals received via ports 114. The MIDI protocol and information regarding how to implement the MIDI protocol is available from the International MIDI Association. A pseudocode listing of the presently preferred microprocessor programming is set forth in the Appendix hereto.

Referring to the pseudocode listing, if desired, upon activation of the microprocessor/computer 116 the control program is automatically executed. The program begins by initializing the microprocessor's I/O ports, setting the proper input/output direction and configuring the serial communication interface (SCI) port to comply with the MIDI standard. After initialization, the control program sequentially scans the rows of key switches while also sequentially updating the LED displays. If a key press is detected during the scan, its identification value is stored in a buffer in memory within microprocessor 116. Sequentially scanning the keypad and LED display in this fashion results in efficient use of the microprocessor's I/O lines. It also reduces hardware complexity by using a single LED driver.

When the microprocessor receives a key press message, it sends the appropriate MIDI Program Change message. The presently preferred control program includes an interrupt service routine for handling RF input data or MIDI IN data entering MIDI IN port. When an interrupt occurs, the executing display and keyboard (keypad) scan routine is suspended. Separate RF interrupt routines and MIDI IN interrupt routines are provided. By handling RF input data and MIDI IN data in this fashion, fast response to these signals is assured.

The continuous controller routine is called by the display and keyboard scan routine. The continuous control routine records the present analog input as seen on analog ports PE2 and PE3. When a change in the converted digital value is encountered, the microprocessor/computer 116 sends the appropriate MIDI control change messages. The microprocessor is also responsible for performing MIDI mapping. This is accomplished by a lookup table in the microprocessor's on-chip EEPROM. EEPROM is presently preferred because it is electrically erasable and allows for the last programmed set of MIDI maps to be saved, even when the unit is powered down.

Figure 14:
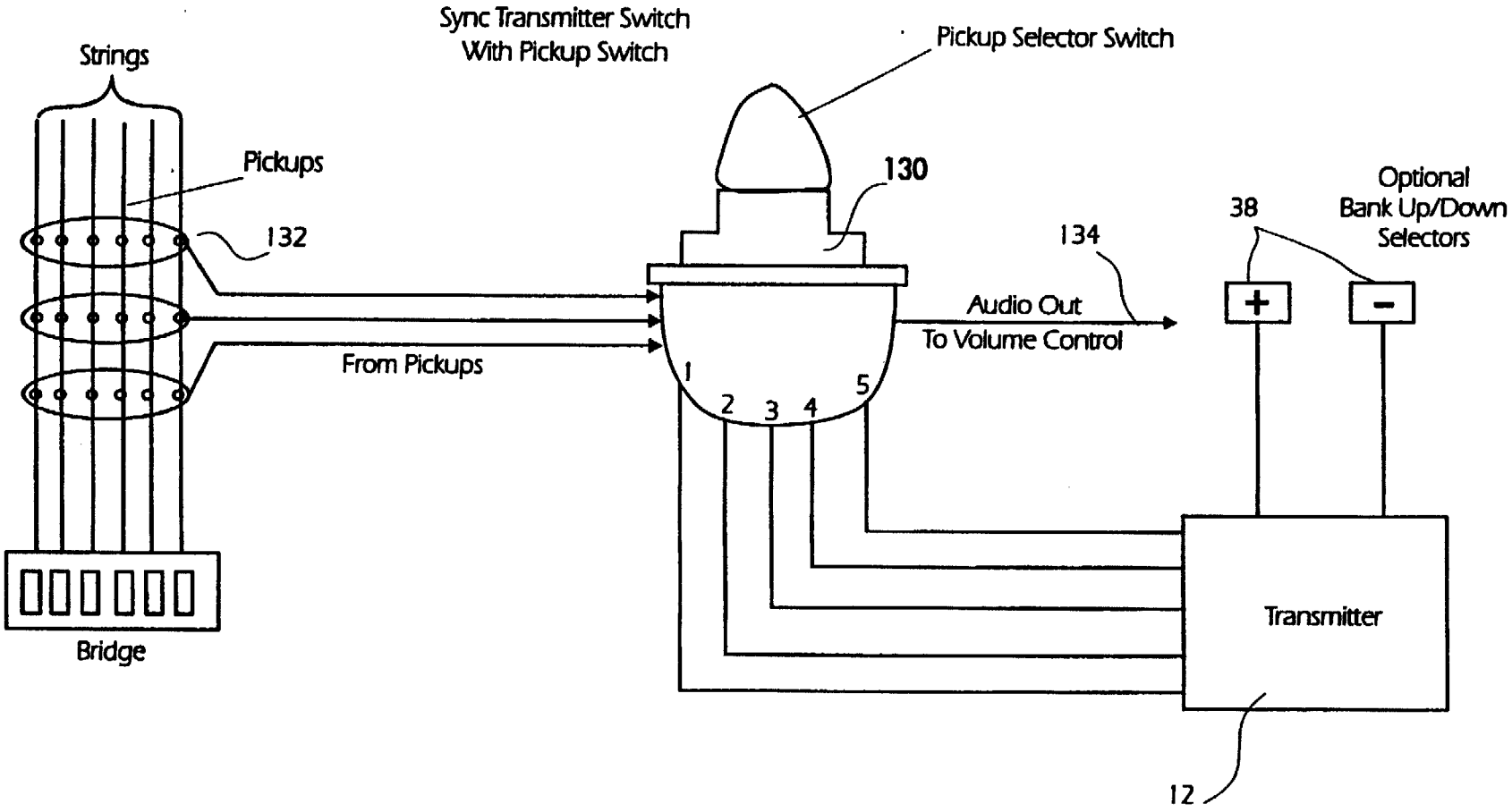
FIG. 14 illustrates an alternate embodiment of the invention in which the transmitter is coupled to work in synchronism with the pickup selector switch.

Another embodiment of the invention is illustrated in FIG. 14. The transmitter may be incorporated into the guitar, as by placing it in a hollowed out compartment beneath the pick guard. The transmitter is connected to the pickup selector switch 130. The selector switch may be a ganged switch or multiple pole switch to accommodate this. Switch 130 is also coupled to the pickups 132. Thus by selecting a specific switch setting on switch 130, the selected pickup or group of pickups is coupled to the audio output lead 134. At the same time, switching instructions are provided to transmitter 12, thus enabling the musician to Select pickup and program simultaneously. The transmitter 12 can be attached to any of the popular pickup selectors, such as the Fender 3-way and 5-way pickup selectors and the Gibson 2-way or 3-way pickup selectors, or the like. If desired, optional bank selection switches 38 may be provided. These may be mounted to the top of the guitar, where they may be accessed easily during play.

Figure 15:
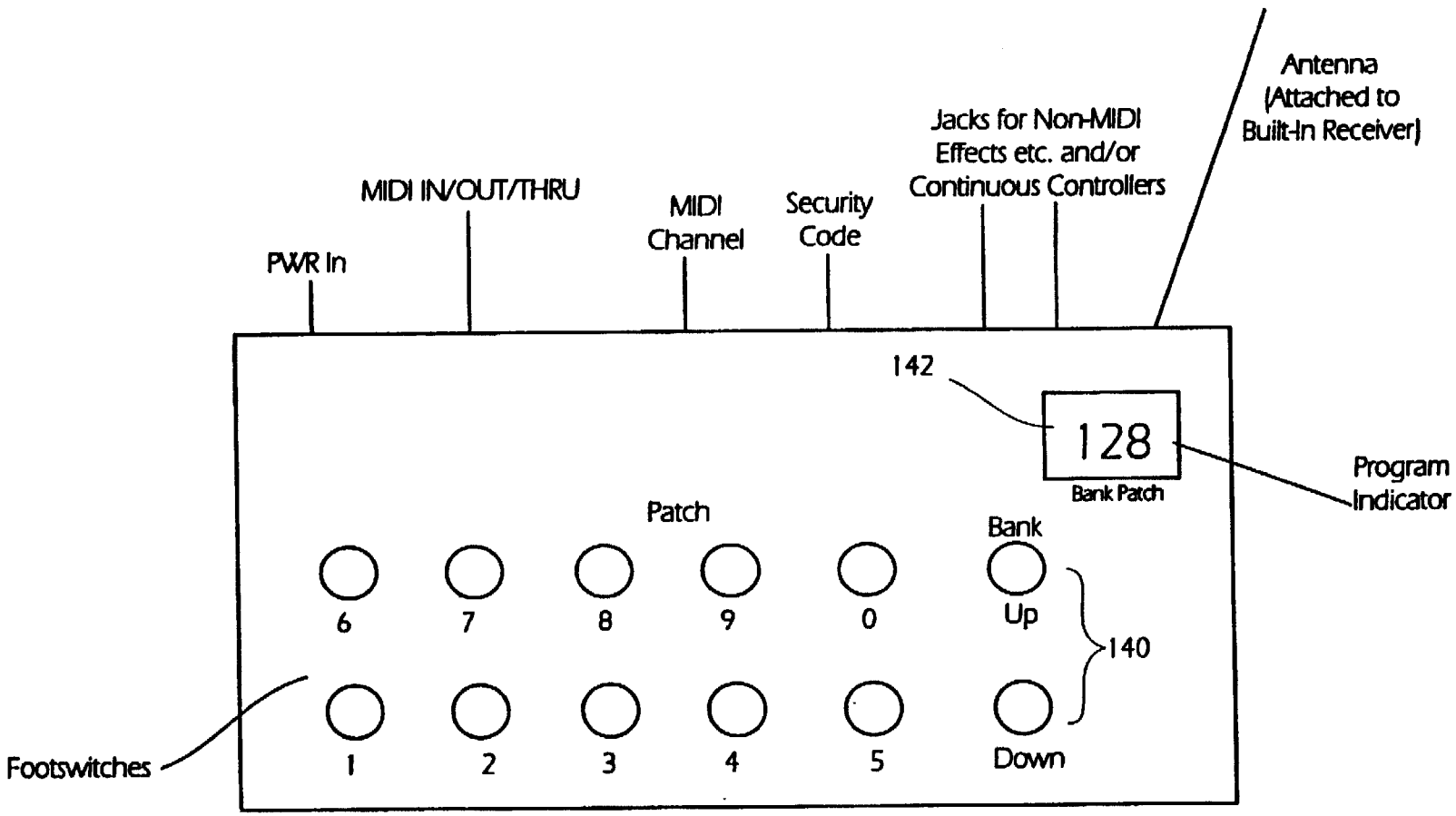
FIG. 15 illustrates an alternate configuration of the invention.

Although the present invention can eliminate the need for footpedals, some musicians may still prefer the option of using footpedals. In FIG. 15, a MIDI foot controller employing the wireless system of the invention is illustrated. Essentially, a plurality of foot-activated buttons 140 are provided. If desired, a bank and patch display readout 142 may be included. The receiver circuitry and MIDI switching circuitry of the invention may be housed in this foot controller, so that the previously described transmitter unit can be used to select the bank and patches wirelessly. This gives the musician the option of using the foot to control the effects or to use the buttons on the transmitter unit.

In yet another embodiment, the foot controller unit of FIG. 15, itself, serves as the transmitter unit. In such embodiment the transmitter circuitry is housed in the foot controller and the foot controller thus sends wireless signals to the receiver unit previously described.

Figure 16:
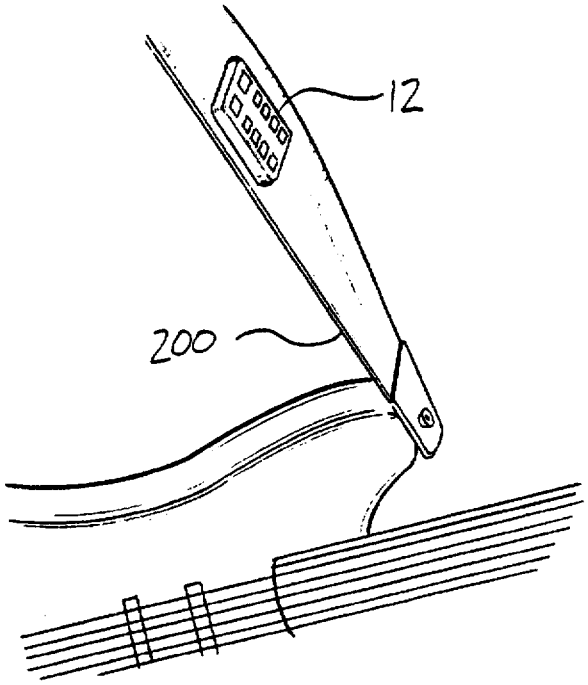
FIG. 16 illustrates an alternate placement of the switch bank unit on a musical instrument shoulder strap.

Still further embodiments are illustrated in FIGS. 16–24. In FIG. 16 the switch bank unit 12 is fastened to the guitar strap 200. Suitable attachment means such as Velcro are pinned on using pin or stud with clip-on button or back.

Figure 17:
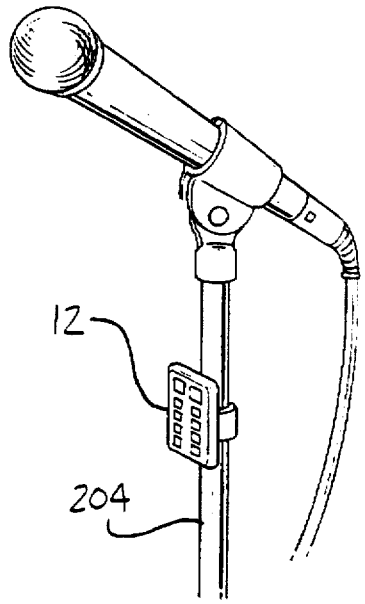
FIG. 17 illustrates an alternate placement of the switch bank unit on a microphone stand.
Figure 18:
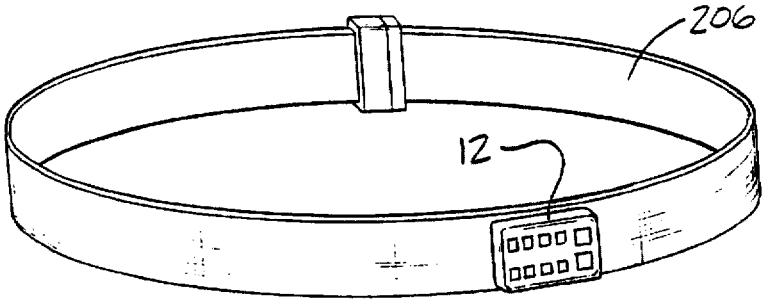
FIG. 18 shows an alternate placement of the switch bank unit on the musician's belt.
Figure 19:
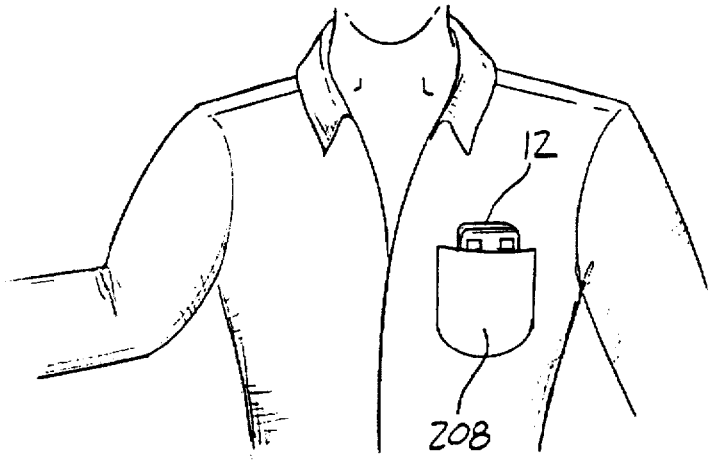
FIG. 19 shows yet another alternate placement of the switch bank unit onto the musician's pocket.

As illustrated in FIG. 17, the switch bank unit 12 may be clipped onto a microphone stand 204 using a suitable C-shaped retention clip. The switch bank unit may also be adapted to be worn on the musician's clothing. This is illustrated in FIG. 18, with the switch bank unit attached by a suitable clip to the musician's belt 206. Alternatively, as illustrated in FIG. 19, the switch bank unit may be clipped to the musician's pocket 208. Any suitably positioned pocket will do, such as a pants pocket, shirt pocket or jacket pocket.

In some instances, depending on the musician's stage act, it may be desirable to secure the switch bank unit 12 to the musician's body. This may be accomplished by a wrist strap around the arm, as illustrated in FIG. 20, or a wrist strap around the wrist, as illustrated in FIG. 23, or as a necklace or neck strap as illustrated in FIG. 24.

Additionally, in some applications the musician may prefer placing the switch bank unit on a suitable surface such as a tabletop (illustrated in FIG. 21), where the unit can be readily picked up for hand-held use (illustrated in FIG. 22).

While the foregoing has illustrated a number of different switch bank configurations, other configurations are also possible. In this regard, the aforegoing examples are intended principally to illustrate some of the different possible configurations and uses of the invention. While MIDI-controlled effects devices are presently very popular with guitar players, MIDI-controlled effects are also growing in popularity with horn players, vocalists, percussionists and drummers. Therefore, the present switch bank unit can be adapted for use by all of these musicians, as will be evident from the foregoing examples.

While the invention has been described in its presently preferred form, it will be understood that modifications can be made without departing from the spirit of the invention as set forth in the amended claims.

APPENDIX

| | Port Data: |
|---|---|
| Initialization Routine: | |
| Configure Ports | |
| Configure SCI to 31.25Kbaud,Async, 1Start,8Data,1Stop | |
| Read MIDI Channel Switches | (PE4 to PE7) |
| Store MIDI Channel Data in CHBuffer | |
| Retireve default MIDI Program No. From EEPROM | |
| Store MIDI Program No. in Key Buffer | |
| Inhibit LED Display | (PB5=0,PB6=0,PB7=0) |
| Display and Keyboard Scan Routine: | |
| Select 1st Row of front panel switches | (PB0=1,PB1=0, PB2=0,PB3=0) |
| Read Keypad data | (PA0,PA1,PA2) |
| If Keypad data>0 then a Key is Pressed | |
| Store Key Data In Key Buffer. | |
| End IF | |
| Load 1's LED data from CHBuffer | (PB0 to PB3) |
| Latch Data | (PB4=1) |
| Select 1's LED only | (PB5=1,PB6=0,PB7=0) |
| Release Latch | (PB4=0) |
| Select 2nd row of fron panel switches | (PB0=0,PB1=1, PB2=0,PB3=0) |
| Read Keypad data | (PA1,PA1,PA2) |
| If Keypad data>0 then a Key is Pressed | |
| Store Key Data In Key Buffer. | |
| End IF | |
| Load 10's LED data from CHBuffer | (PB0 to PB3) |
| Latch Data | (PB4=1) |
| Select 1's LED | (PB6=1,PB5=0,PB7=0) |
| Release Latch | (PB4=0) |
| Select 3rd row of front panel switches | (PB0=0,PB1=0, PB2=1,PB3=0) |
| Read Keypad data | (PA0,PA1,PA2) |
| If Keypad data>0 then a Key is Pressed | |
| Store Key Data In Key Buffer. | |
| End IF | |
| Load 100's LED data from CHBuffer | (PB0 to PB3) |
| Latch Data | (PB4=1) |
| Select 100's LED | (PB5=0,PB6=0,PB7=1) |
| Release Latch | (PB4=0) |
| Select 4th row of front panel switches | (PB0=0,PB1=0, PB2=0,PB3=1) |
| Read Keypad data | (PA0,PA1,PA2) |
| If Keypad data>0 then a Key is Pressed | |
| Store Key Data In Key Buffer. | |
| End IF | |
| Update CHBuffer | |
| If Updated Key Buffer data is new then | |
| Send MIDI program change message | (PD1) |

APPENDIX-continued

| | Port Data: |
|---|---|
| End If | |
| RF Interrupt Routine: | (PC0 to PC7) |
| | (PE0) |
| Place RF data in RF Buffer | (PE1) |
| Read Left Signal Strength (LSS) | |
| Read Right Signal Strength (RSS) | |
| Compare LSS to Threshold Value | (PA3=1) |
| If LESS < Threshold Then | |
| Activate Left Red LSD (signal strength ind.) | |
| End If | (PA4=1) |
| If LSS >= Threshold Then | |
| Activate Left Green LED (signal strength ind.) | |
| End If | |
| Compare RSS to Threshold Value | (PA5=1) |
| If RSS < Threshold Then | |
| Activate Right Red LED (signal strength ind.) | |
| End If | (PA6=1) |
| If RSS >= Threshold Then | |
| Activate Right Green LED (signal strength ind.) | |
| End If | |
| Compare LSS to RSS | (PC0-PC3) |
| If LSS >= RSS then | |
| Transfer data from PC0 to PC3 to Key Buffer | |
| Update LED Display CHBuffer | (PC4-PC7) |
| Else | |
| Transfer data from PC4 to PC7 to Key Buffer | |
| Update LED Display CHBuffer | |
| End If | |
| Return to Display and Keyboard Scan Routine | |
| MIDI IN Interrupt Routine: | |
| Update LED display CHBuffer | |
| Update KeyBuffer | |
| Return to Display and Keyboard Scan Routine | |
| Continuous Controller Routine: | |
| Check if present value of CCBIF (Continuous Controller Buffer Init Flag) is set (power up state). If initial value then | |
| read PE1 and PE2 and store in CCB1 and CCB2 (Continuous Control Data Buffers) | |
| Clear CCBIF | |
| End If | |
| Read PE1 | (PE1) |
| Store value of PE1 in CCB1N (New Value) | |
| Read PE2 | (PE2) |
| Store value of PE2 in CCB2N (New Value) | |
| Check for change in CCB1 (CCB1N-CCB1_NE 0) | |
| If CCB1 has changed then send Control Change MIDI message | |
| End If | |
| Check for change in CCB1 (CCB2N-CCB2_NE 0) | |
| If CCB1 has changed then send Control Change MIDI message | |
| End If | |
| Return to Display and Keyboard Scan Routine | |

What is claimed is:

1. A wireless remote controlled musical instrument switching system for use with a musical instrument of the type that produces a musical signal representing musical notes and for use with a signal processor or amplifier that alters the quality of the musical signal, comprising:

a switch bank comprising a self-contained package that includes at least one manually actuable switch having means for placement in proximity to a musician;

a transmitter coupled to said switch bank for emitting a radiated signal in response to actuation of said switch;

said radiated signal comprising sound effecting information different than said musical signal;

a receiver for receiving said radiated signal and for producing a control signal corresponding to the actuation of said switch;

a musical device switching interface coupled to said receiver for producing MIDI protocol digital signals in accordance with said control signal said interface being adapted to control said signal processor or amplifier in accordance with said sound effecting information.

2. The system of claim 1 wherein said switch bank and said transmitter are mounted in a common package.

3. The system of claim 1 wherein said transmitter emits a radio frequency radiated signal.

4. The system of claim 1 wherein said transmitter emits an infrared radiated signal.

5. The system of claim 1 wherein said switch bank includes a plurality of switches, and wherein said transmitter further includes multiplexing circuit coupled to said plurality of switches, for producing a plurality of unique serial signals each representing one of said switches.

6. The system of claim 5 wherein said receiver further comprises demultiplexing circuit for decoding said plurality of unique serial signals and for producing a different MIDI protocol digital signal in response to each of said unique serial signals.

7. The system of claim 1 wherein the musical instrument is a guitar having a plurality of pickups controlled by a pickup selector switch and wherein said switch bank at least in part comprises said pickup selector switch.

8. The system of claim 1 wherein said switch bank is adapted for attaching to a guitar strap.

9. The system of claim 1 wherein said switch bank is adapted to be carried on the musician's person.

10. The system of claim 1 wherein said switch bank is adapted for attachment to a microphone stand.

11. A wireless remote controlled musical instrument switching system for use with a musical instrument of the type that produces a musical signal representing musical notes and for use with a signal processor or amplifier that alters the quality of the musical signal, comprising:

a switch bank comprising a self-contained package that includes at least one manually actuable switch having means for placement in proximity to a musician;

a transmitter coupled to said switch bank for emitting a radiated signal in response to actuation of said switch;

said radiated signal comprising sound effecting information different than said music signal;

a receiver for receiving said radiated signal and for producing a control signal corresponding to the actuation of said switch;

a musical device switching interface coupled to said receiver for producing ON/OFF signals in accordance with said control signal said interface being adapted to control said signal processor or amplifier in accordance with said sound effecting information.

12. The system of claim 11 wherein said switch bank and said transmitter are mounted in a common package.

13. The system of claim 11 wherein said transmitter emits a radio frequency radiated signal.

14. The system of claim 11 wherein said transmitter emits an infrared radiated signal.

15. The system of claim 11 wherein said switch bank includes a plurality of switches, and wherein said transmitter further includes multiplexing circuit coupled to said plurality of switches, for producing a plurality of unique serial signals each representing one of said switches.

16. The system of claim 15 wherein said receiver further comprises demultiplexing circuit for decoding said plurality of unique serial signals and for producing a different MIDI protocol digital signal in response to each of said unique serial signals.

17. The system of claim 11 wherein the musical instrument is a guitar having a plurality of pickups controlled by a pickup selector switch and wherein said switch bank at least in part comprises said pickup selector switch.

18. The system of claim 11 wherein said switch bank is adapted for attaching to a guitar strap.

19. The system of claim 11 wherein said switch bank is adapted to be carried on the musician's person.

20. The system of claim 11 wherein said switch bank is adapted for attachment to a microphone stand.

* * * * *